US009510990B2

(12) United States Patent
Workman et al.

(10) Patent No.: US 9,510,990 B2
(45) Date of Patent: Dec. 6, 2016

(54) GAIT TRAINING APPARATUSES, ATTACHMENTS FOR GAIT TRAINING AND RELATED METHODS

(76) Inventors: Michael J. Workman, Salt Lake City, UT (US); Ernest P. Robison, Murray, UT (US)

( * ) Notice: Subject to any disclaimer, the term of this patent is extended or adjusted under 35 U.S.C. 154(b) by 1589 days.

(21) Appl. No.: 12/861,665

(22) Filed: Aug. 23, 2010

(65) Prior Publication Data

US 2012/0042917 A1 Feb. 23, 2012

(51) Int. Cl.
*A61H 3/00* (2006.01)
*A61H 3/04* (2006.01)

(52) U.S. Cl.
CPC ..... *A61H 3/008* (2013.01); *A61H 3/04* (2013.01); *A61H 2201/163* (2013.01); *A61H 2201/1621* (2013.01); *A61H 2201/1635* (2013.01); *A61H 2201/1652* (2013.01); *Y10T 29/49826* (2015.01)

(58) Field of Classification Search
USPC ..... 135/66, 67; 182/3, 231, 232; 248/328, 248/329, 330.1; 486/66, 68, 69
See application file for complete search history.

(56) References Cited

U.S. PATENT DOCUMENTS

| | | | | |
|---|---|---|---|---|
| 2,459,066 | A * | 1/1949 | Duke | 297/5 |
| 2,625,202 | A * | 1/1953 | Richardson et al. | 482/68 |
| 2,719,568 | A * | 10/1955 | Webb | 482/68 |
| 3,711,877 | A * | 1/1973 | Averill | 5/87.1 |
| 3,999,228 | A * | 12/1976 | Thomas | 5/83.1 |
| 4,164,350 | A * | 8/1979 | Zeijdel et al. | 482/69 |
| 4,211,426 | A * | 7/1980 | Motloch | 280/87.041 |
| 5,333,333 | A * | 8/1994 | Mah | 5/87.1 |
| 5,603,677 | A * | 2/1997 | Sollo | 482/69 |
| 6,845,736 | B1 * | 1/2005 | Anderson | 119/796 |
| 7,275,554 | B2 * | 10/2007 | Mullholand | 135/67 |
| 7,294,094 | B1 * | 11/2007 | Howle | 482/69 |
| 7,468,023 | B2 * | 12/2008 | Wu et al. | 482/69 |
| 2005/0250624 | A1 * | 11/2005 | Yu | 482/69 |

* cited by examiner

*Primary Examiner* — Noah Hawk

(57) ABSTRACT

Attachments, apparatuses, and methods for partial weight bearing gait training are described. Attachments for partial weight bearing gait training may include a structure sized and configured for attachment to a walker, an undampened elastic member, and a harness. Apparatuses may include a walker with a walker frame and at least two wheels, a harness support base frame connected to the walker, a suspension arm coupled to the harness support base frame, an undampened elastic member connected to the suspension arm, and a harness connected to the undampened elastic member. Related methods of assembling a gait training apparatus and of using a gait training device are also described.

2 Claims, 7 Drawing Sheets

GAIT TRAINING APPARATUSES, ATTACHMENTS FOR GAIT TRAINING AND RELATED METHODS

TECHNICAL FIELD

The invention, in various embodiments, relates to apparatuses, methods, and attachments for gait training.

BACKGROUND

Partial weight bearing gait training devices (also referred to as unweighting systems) are used by medical personnel during physical therapy to improve the mobility of a patient and to help the patient gain strength and range of motion. The term "gait training" generally refers to a method of training a person to walk, and the term "partial weight bearing" refers to one particular example of gait training. Partial weight bearing gait training may be a method of training a patient to walk wherein the weight of the patient is partially supported by some device, and the amount of weight relief provided by the device for the patient is gradually reduced as the patient learns to walk normally. In other words, over a period of time, gait training assists the patient in becoming physically capable of supporting his or her own full weight while walking.

Institutions such as hospitals, nursing homes, physical therapy clinics, physiatrists in private practice, school systems, outpatient centers, and rehabilitation facilities have had the need to provide both inpatient and outpatient physical therapy services for patients who experience difficulty in walking who require gait training, including partial weight relief of the patient during such training. Typically, the amount of weight relief provided a patient undergoing gait training is reduced over time as the course of the gait training progresses.

In some cases, partial weight bearing gait training devices include an overhead framework, track, or anchor from which a harness or other support hangs. The patient may be positioned in the harness and practice walking along the track or within the framework with his or her weight partially supported by the device. Such devices are sometimes used over treadmills to provide more exercise for the patient.

Another method of gait training involves the use of walkers. Walkers are used by children and adults. These devices are typically used by persons who have some ambulatory ability, but who need assistance with support or balance. Walkers typically have frames that the user grips with his or her hands or leans on with his or her forearms for support. The walker, in combination with the strength provided by the arms and torso, provides balance to the user, and allows the user's upper body strength to assist the legs in walking. Walkers may, or may not, have two or more wheels. Walkers may be lightweight, allowing the user to easily push or pull the walker. Some walkers have a frame that wraps around the front of the user as the user walks, and others have a frame that wraps around the back of the user as the user walks. The latter may be referred to as "posterior rolling walkers."

BRIEF SUMMARY

In some embodiments, an attachment for partial weight-bearing gait training is described that includes a structure sized and configured for attachment to a walker, an undampened elastic member that is configured to attach to the structure, and a harness configured for connection to the undampened elastic member.

In additional embodiments, a gait training apparatus is described, including a walker with a frame and at least two wheels, a harness support base frame attached to the walker frame, a suspension arm coupled to the harness support base frame, an undampened elastic member connected to the suspension arm, and a harness connected to the undampened elastic member.

In further embodiments, methods of assembling a gait training apparatus are described, including connecting a harness support base frame to a gait training device, coupling an at least substantially vertical suspension arm to the harness support base frame, connecting an elastic member to the support arm, and attaching a harness to the elastic member.

In additional embodiments, methods of using a gait training device are described that include positioning a patient in a harness, connecting an elastic member to the harness, attaching a suspension arm to the gait training device, and hanging the harness from the support arm by the elastic member.

BRIEF DESCRIPTION OF THE SEVERAL VIEWS OF THE DRAWINGS

While the specification concludes with claims particularly pointing out and distinctly claiming that which are regarded as embodiments of the present invention, advantages of embodiments of the invention may be more readily ascertained from the description of certain example embodiments of the invention set forth below, when read in conjunction with the accompanying drawings.

DETAILED DESCRIPTION

Figure 1:
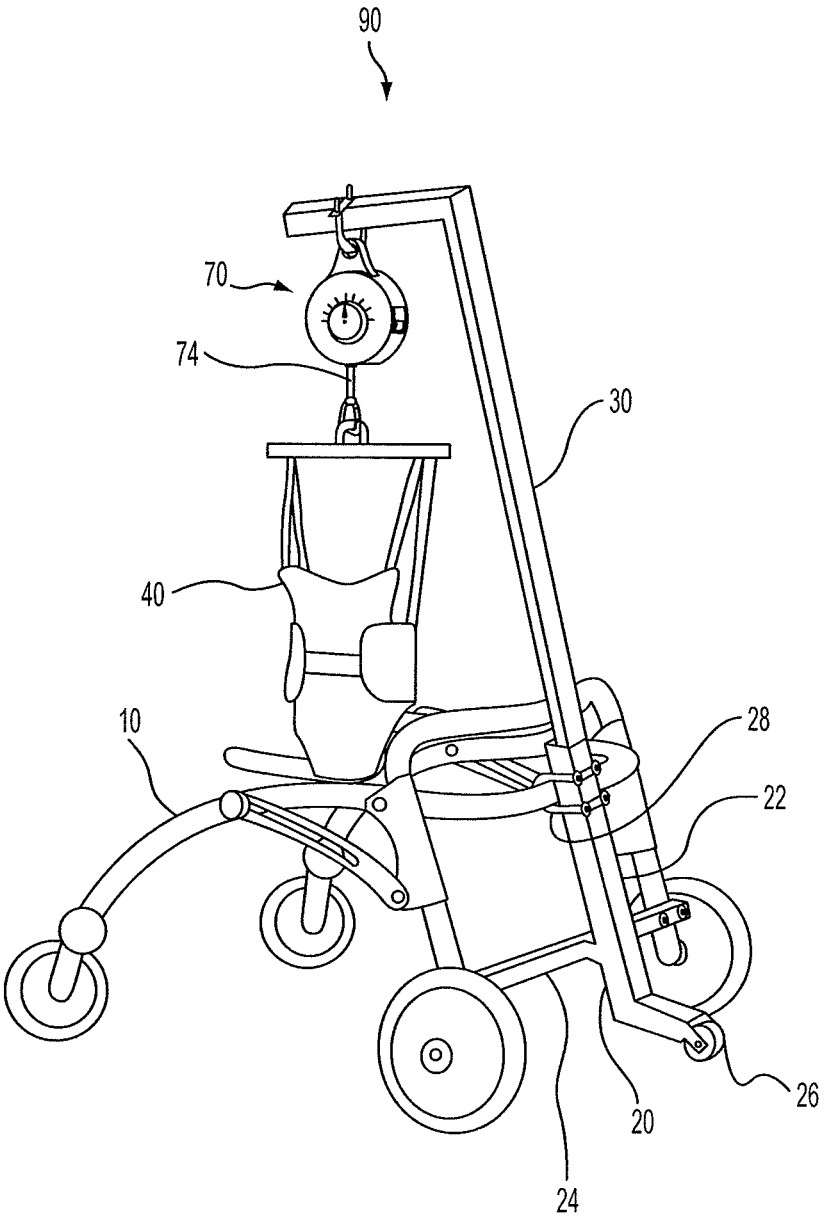
FIG. 1 shows a perspective view of a gait training apparatus according to an embodiment of the invention.

The illustrations presented herein are not meant to be actual views of any particular gait training apparatus or portion thereof, but are merely idealized representations that are employed to describe embodiments of the present invention. Additionally, elements common between figures may retain the same numerical designation.

As used herein, the term "elastic member" means a member that can return to its original shape after being significantly stretched, expanded, or elongated. By way of a specific example, an elastic member may be stretched or elongated at least 25% beyond its original length and subsequently return to its original length without substantial plastic (i.e., permanent) deformation. Even more specifically, an elastic member may be capable of stretching 50% beyond its original length and subsequently return to its original length without substantial plastic deformation. Some elastic members may experience 100% or more elongation and subsequently return to an original length without substantial plastic deformation. By way of non-limiting examples, an elastic member may include a spring, a bungee cord (also referred to as a shock cord or elastic shock cord), an elastic rope, a rubber cord, a cord comprising a polymer, latex, polypropylene, a woven elastic strap, etc.

As used herein, the term "undampened" means lacking a device that is intended to substantially dampen oscillatory movement. An undampened member, therefore, is a member that lacks a device or element that is intended to substantially eliminate, diminish, or slow movement (such as vibration, oscillation, or translation) of the member in one or more directions. Thus, an undampened elastic member is an elastic member that lacks, for example and without limitation, a corresponding dashpot or shock absorber.

As used herein, the term "gait training device" refers to any device used to strengthen, teach, train, assist, or otherwise improve the walking, crawling, or other self-powered mobility of a patient. For example, gait training devices may include a walker (including a posterior rolling walker) or a treadmill. Gait training devices may be used to help, for example: young people learning to walk or crawl; people who are mentally or physically disabled; individuals who have suffered injuries impairing walking, balance, and coordination; victims of neurologic injuries, such as a stroke, a spinal cord injury, paraplegia, a head injury, etc.; patients who have undergone surgery; or people who have reduced mobility due to age, arthritis, degenerative diseases, or developmental deficiencies, such as cerebral palsy, spina bifida, Down syndrome, prematurity, and other genetic and metabolic disorders.

As used herein, the term "patient" means any person, adult or child, who uses a gait training device to learn or strengthen physical mobility.

As used herein, any directional language (e.g., vertical, horizontal, upright, bottom, top, etc.) refers to an orientation relative to a device during the normal operation thereof. The normal operation of a device is the intended use of the device. For example, a vertical member on a walker is a member that is at least substantially vertical when a person is using the walker to help with walking, as the walker is intended to be used. Not all elements or dimensions of a vertical member need be substantially vertical; however, the longest dimension of the overall member may be at least substantially vertical.

As used herein, the term "at least substantially vertical," refers to an orientation that is less than about 45 degrees from vertical. In some non-limiting examples, a member that is at least substantially vertical may be oriented at less than 30 degrees from vertical. By way of further example, an at least substantially vertical member may be oriented at less than 15 degrees from vertical.

As used herein, the term "removably coupling" or "removably connecting" refers to coupling or connecting in a manner that allows for removal without the use of tools or instruments apart from the apparatus. Thus, by way of non-limiting example, if a person can readily remove a connected member from an apparatus without the use of a tool, such as a wrench, a screwdriver, pliers, a hammer, etc., then the member is removably connected to the apparatus.

As used herein, the term "single member" refers to a member that may be a unitary structure, or it may be made from several discrete structures that are linked or connected together to form a substantially collinear structure. Thus, for example, a single metal tube is a single member. By way of another example, two or more members connected end-to-end substantially collinearly also may be referred to as a single member. However, two poles that are parallel to each other and spaced laterally apart from each other at a significant distance are not a single member.

Referring now to FIG. 1, in some embodiments, a gait training apparatus 90 may include a walker 10, a harness support base frame 20, a suspension arm 30, an elastic member 74, and a harness 40. Each of these components of the gait training apparatus 90 and their assembly together will be discussed in further detail hereinafter. A patient may be positioned in the harness 40 and the structure of the gait training apparatus 90 may support at least some of the patient's weight. The patient may, therefore, receive assistance from the gait training apparatus 90 as the patient walks or otherwise moves while using the gait training apparatus 90. Additionally, the patient may use the gait training apparatus 90 as a fall arrest if the patient has progressed to a point of walking without the need of constant partial weight bearing assistance. The gait training apparatus 90 may roll or otherwise move across a space as the patient pushes or pulls with his or her feet against a surface (e.g., a floor) upon which the gait training apparatus 90 is placed. Thus, gait training may be facilitated by use of the gait training apparatus 90.

Figure 2:
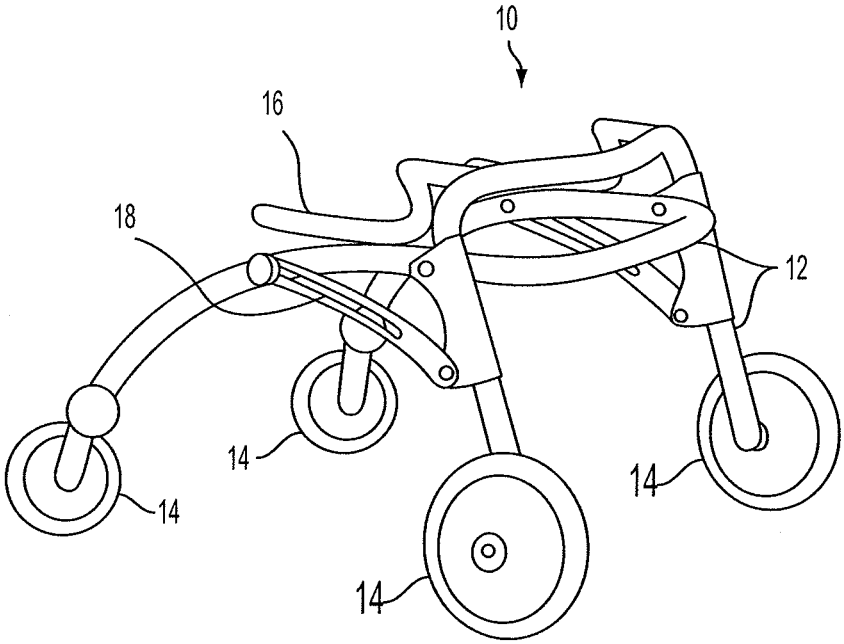
FIG. 2 shows a perspective view of a posterior rolling walker of the gait training apparatus of FIG. 1.

Referring to FIG. 2, in some embodiments, a walker 10 (shown here as a posterior rolling walker) may include a frame 12, with two or more wheels 14 connected thereto. The walker 10 may have handles 16 to allow a patient to grasp the walker 10 to support the patient's weight and therefore assist in moving across a space. The walker 10 may also include a folding mechanism 18 to fold up the walker 10 when not in use for ease of storage and transportation. Posterior rolling walkers, such as the one shown in FIG. 2, are intended to wrap around the sides and back of the patient while the patient is using the posterior rolling walker for gait training or other ambulatory assistance. In other embodiments (not shown), walkers other than a posterior rolling walker 10 may be utilized. By way of non-limiting examples, gait training devices, such as anterior rolling walkers, rollators, platform walkers, pediatric walkers, adjustable height ambulators, or treadmills, may be used. Optionally, one or more additional features may be included on the gait training device, including, for example, brakes, arm supports, a seat, a motor, leg straps, or combinations thereof.

Figure 3:
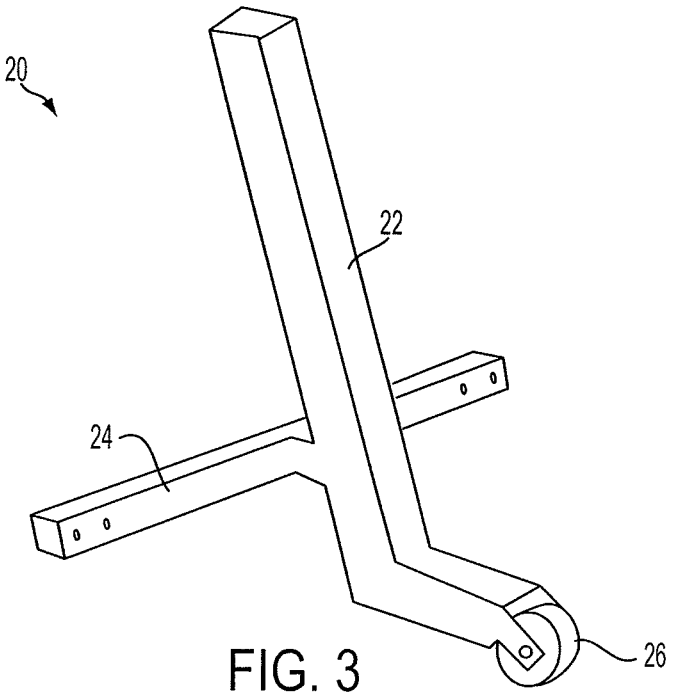
FIG. 3 shows a perspective view of a harness support base frame of the gait training apparatus of FIG. 1.

Referring now to FIG. 3, in some embodiments, a harness support base frame 20 may be sized and configured for attachment to the posterior rolling walker 10 of FIG. 2, or other gait training device, as previously described. The harness support base frame 20 may have a first elongated member 22 in a first orientation for receiving an end of a suspension arm 30 (the suspension arm will be described in more detail hereinafter). One or more support wheels 26 may also be attached to the harness support base frame 20 to increase the stability of the assembly. The harness support base frame 20 may also include a second elongated member 24, also referred to as a crossbar 24, for additional support and stability of the assembly. The crossbar 24 may be connected to the first elongated member 22 at a second orientation, which may be at least substantially orthogonal to the orientation of the first elongated member 22. However, in other embodiments, the crossbar 24 may not be substantially orthogonal to the first elongated member 22, but may be oriented at any angle or configuration that is convenient to provide support and stability to the inventive structure. The crossbar 24 may be connected to the first elongated member 22 by welding, mechanical interference, fasteners, adhesive, or any other connection means appreciated by one of ordinary skill in the art. Optionally, the first elongated member 22 and crossbar 24 may be integrally formed as a unitary structure by, for example, stamping, bending, cutting, molding, or machining the structure in its final configuration, as will be appreciated by one of ordinary skill in the art.

Both the first elongated member 22 and the crossbar 24 of the harness support base frame 20 may be made of a rigid material. In some embodiments, the first elongated member 22 and crossbar 24 may be square metal tubes. However, it is contemplated that other materials and configurations may be used. By way of non-limiting example, the material used in the first elongated member 22 and the crossbar 24 may be any metal, such as steel (including stainless steel), aluminum, brass, iron, etc. Other examples of the material of the first elongated member 22 and the crossbar 24 include polymer, composites (including fibrous composites, such as carbon fiber and woven materials), fiberglass, and wood. A cross-section of the first elongated member 22 and the crossbar 24 may be square, triangular, rectangular, circular, irregular, or any other shape as may be selected by performance, aesthetics, stability, strength, cost, or other considerations. The first elongated member 22 and crossbar 24 may be hollow or they may be solid. Optionally, in some embodiments, the first elongated member 22 may be formed from a first material in a first configuration and the crossbar 24 may be formed from a second material in a second configuration different from the first.

Figure 4:
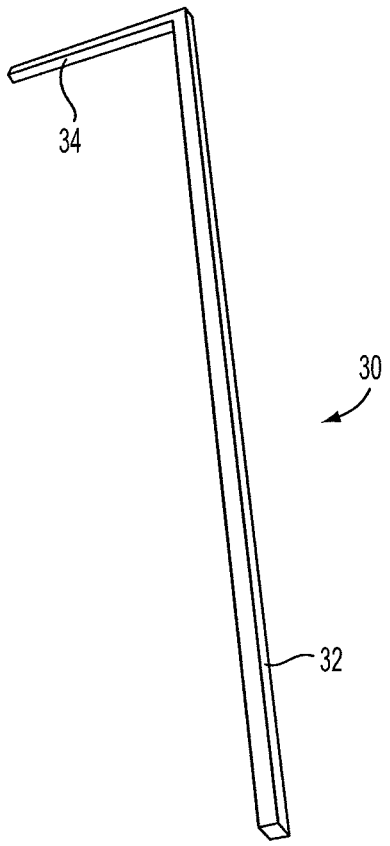
FIG. 4 shows a perspective view of a suspension arm of the gait training apparatus of FIG. 1.

Referring now to FIG. 4, a suspension arm 30 may include a suspension arm upright bar 32 and a harness attachment arm 34. A first, lower end of the suspension arm upright bar 32 may be configured to be complementary to the harness support base frame 20 described hereinabove. The harness attachment arm 34 may attach at or near a second, upper end of the suspension arm upright bar 32 in an orientation that is at least substantially orthogonal to the suspension arm upright bar 32, as shown in FIG. 4. However, in other embodiments, the harness attachment arm 34 may be attached to the suspension arm upright bar 32 at a different angle. In further embodiments, the harness attachment arm 34 may be curved or have some other configuration. By way of further example, in some embodiments, the suspension arm 30 may be a unitary structure, formed of an upright portion and a harness attachment portion. In a particular embodiment, the harness attachment portion may simply be a bent portion of the suspension arm upright bar 32.

The suspension arm 30 may be formed from a variety of materials and in a variety of configurations, as described hereinabove regarding the harness support base frame 20. In some embodiments, the harness attachment aim 34 may be a single, cantilevered arm as shown in FIG. 4.

The suspension arm upright bar 32 and the harness attachment arm 34 may be permanently attached to each other, or otherwise attached to each other. For example, the harness attachment arm 34 may be welded to the upper end of the suspension arm upright bar 32. In other embodiments, the harness attachment arm 34 may be attached to the suspension arm upright bar 32 by fasteners or mechanical interference. Alternatively, the suspension arm upright bar 32 and harness attachment arm 34 may be integrally formed as a unitary structure by, for example, stamping, bending, cutting, molding, or machining the suspension arm 30 in its final configuration, as will be appreciated by one of ordinary skill in the art.

Referring generally to the embodiments shown in FIGS. 5 through 7, an elastic member 74 may be provided for hanging a harness 40 (described in more detail hereinafter) from the suspension arm 30. The elastic member 74 may be sufficiently elastic to allow elastic deformation when a patient is positioned in the harness 40 hanging from the elastic member 74. The elasticity of the elastic member 74 within a specific range of deformation may be generally characterized by the mathematical formula referred to as "Hooke's Law:"

$$F=-k\cdot x \tag{1}$$

Where F is the force exerted by the elastic member 74 when stretched (in units of Newtons (N) or kilogram-meters-per-second-squared ($kg\cdot m/s^2$)), k is the force constant or spring constant of the elastic member (in units of Newtons-per-meter (N/m) or kilograms-per-second-squared ($kg/s^2$)), and x is the displacement of the end of the elastic member, or, in other words, the distance the elastic member is stretched beyond its unstretched or equilibrium length (in units of meters (m)). The negative sign in the equation (1) indicates that the force F is in the opposite direction of the displacement x. The elastic member 74 may be chosen to exhibit a particular extension or stretch over the loads to be expected when a patient of a particular size or a range of sizes uses the apparatus. The spring constant of the elastic member 74 may be related to its unstretched length and to the materials and configurations used in the elastic member 74. If the elastic member 74 exhibits a higher spring constant k, then it will elastically lengthen less under a given load than if the elastic member 74 exhibits a lower spring constant.

For example, if a child weighing approximately 133.4 N (30 lb) is placed in the apparatus and the desired stretch of the elastic member 74 is approximately 0.076 m (3 in.), then Hooke's Law can be solved for k, giving a spring constant k of approximately 1750 N/m. Thus, for the gait training of, for example, children weighing between approximately 44.5 N (10 lb) and approximately 444.8 N (100 lb), and for a desired displacement x between approximately 0.0254 m (1 in.) and approximately 0.3048 m (12 in.), the elastic member 74 may be chosen to exhibit a spring constant k between about 146 N/m and about 17,515 N/m.

In additional embodiments, such as for the gait training of adults weighing between approximately 444.8 N (100 lb) and approximately 1344.5 N (300 lb), with a desired stretch x of between about 0.0254 m (1 in.) and about 0.3048 m (12 in.), the elastic member 74 may be selected to exhibit a spring constant k of between about 1460 N/m and about 52,540 N/m.

In further embodiments, the elastic member 74 may be selected to exhibit a spring constant k between about 290 N/m and about 5840 N/m (for a desired stretch x of about 0.1524 m (6 in.) and for patients weighing between about 44.5 N (10 lb) and 889.6 N (200 lb)). In yet further embodiments, the elastic member 74 may be selected to exhibit a spring constant k between about 1460 N/m and about 14,600 N/m (for a desired stretch x of between about 0.0762 m (3 in.) and about 0.1524 m (6 in.) and for patients weighing between about 222.4 N (50 lb) and about 1112 N (250 lb)).

In additional embodiments, such as for very heavy patients or very light patients, and for very high stretch or very low stretch, the spring constant k of the elastic member 74 may be within a range that is higher or lower than the ranges and values described hereinabove. By way of non-limiting example, the elastic member 74 may be chosen to have a spring constant k of between about 25 N/m and about 200,000 N/m.

Figure 5:
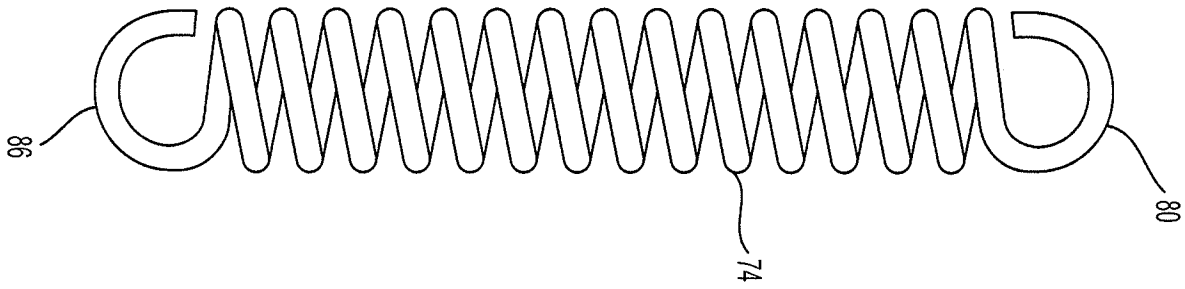
FIG. 5 shows an side view of an elastic member for use with a gait training apparatus, such as shown in FIG. 1.

Referring to FIG. 5, in some embodiments, the elastic member 74 may include a spring. The elastic member 74 may include an elastic member attachment 80 at or near one end for attachment to the suspension arm 30 (FIG. 4). The elastic member attachment 80 may be, by way of non-limiting example, one or more of a hook, a ring, a carabiner, a snap, a loop, a bracket, an adhesive, a hook-and-loop type fastener, another fastener, and a combination of fasteners or attachments. At the other, lower end of the elastic member 74, there may be a harness attachment 86 which also may be, for example, one or more of a hook, a ring, a carabiner, a snap, a loop, a bracket, and another fastener. In additional embodiments, one or more of the elastic member attachment 80 and the harness attachment 86 may be omitted, and one or more of the suspension arm 30 and the harness 40 (FIG. 1) may be attached directly to a corresponding end of the elastic member 74.

In some embodiments, the elastic member 74 may be undampened. As will be explained in more detail hereinafter, the lack of a damper may facilitate gait training.

Figure 6:
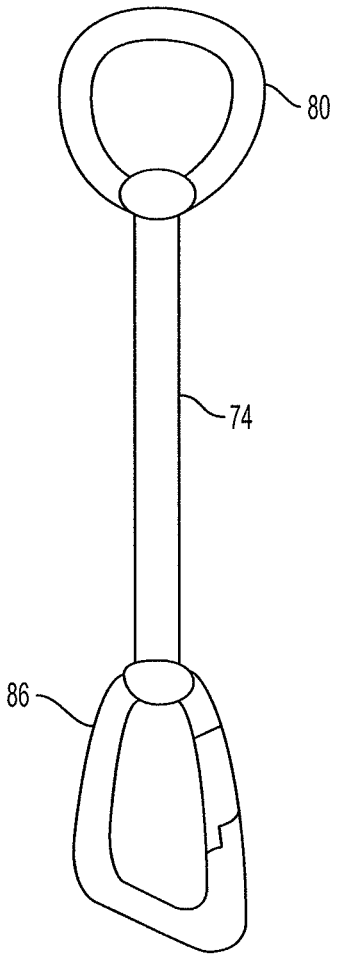
FIG. 6 shows a side view of an elastic member with attachment structures for use with a gait training apparatus, such as shown in FIG. 1.

In some embodiments, as shown in FIG. 6, the elastic member 74 may be a bungee or shock cord. This type of elastic member 74 typically comprises a core made from multiple filaments of elastic material, such as polypropylene. The core may be surrounded by a woven jacket comprising, for example, cotton or another fabric. In additional embodiments, a thicker strand of rubber or other elastic material may be used for the elastic member 74. The elastic member 74 may be, for example, a bungee cord, a rope, a rubber cord, a cord comprising a polymer, a latex cord or strap, a polypropylene cord or strap, a woven elastic strap, etc. However, other materials or groups of materials of sufficient elasticity may be used for the elastic member 74. By way of non-limiting example, the elastic member 74 may be of a predetermined length, and extend between an elastic member attachment 80 and a harness attachment 86, as described hereinabove.

Figure 7:
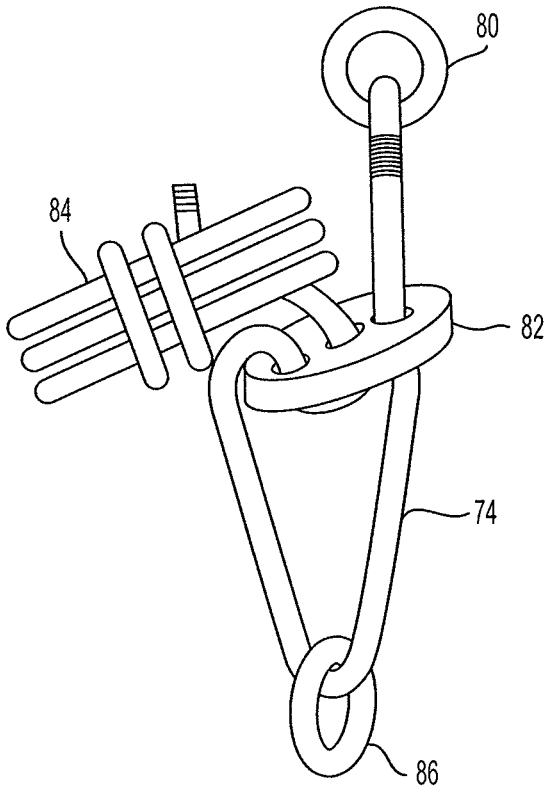
FIG. 7 shows a side view of an adjustable-length elastic member and associated hardware for use with a gait training apparatus, such as shown in FIG. 1.

Referring now to FIG. 7, in some embodiments, an elastic member 74, such as, for example, a bungee cord, may be used in conjunction with a length adjustment device 82 to facilitate adjusting the height at which a harness 40 hangs, to accommodate patients of different sizes and ambulatory abilities. By way of non-limiting example, the length adjustment device 82 may be a block with one or more holes therein configured for passing the elastic member 74 therethrough. As the elastic member 74 is fed through the length adjustment device 82, the overall length of the elastic member 74 from the elastic member attachment 80 to the harness attachment 86 may be adjusted. In some embodiments, excess elastic member 74, if any, may be gathered in a bundle or coil 84, or it may hang free without any bundle or coil 84.

Figure 8:
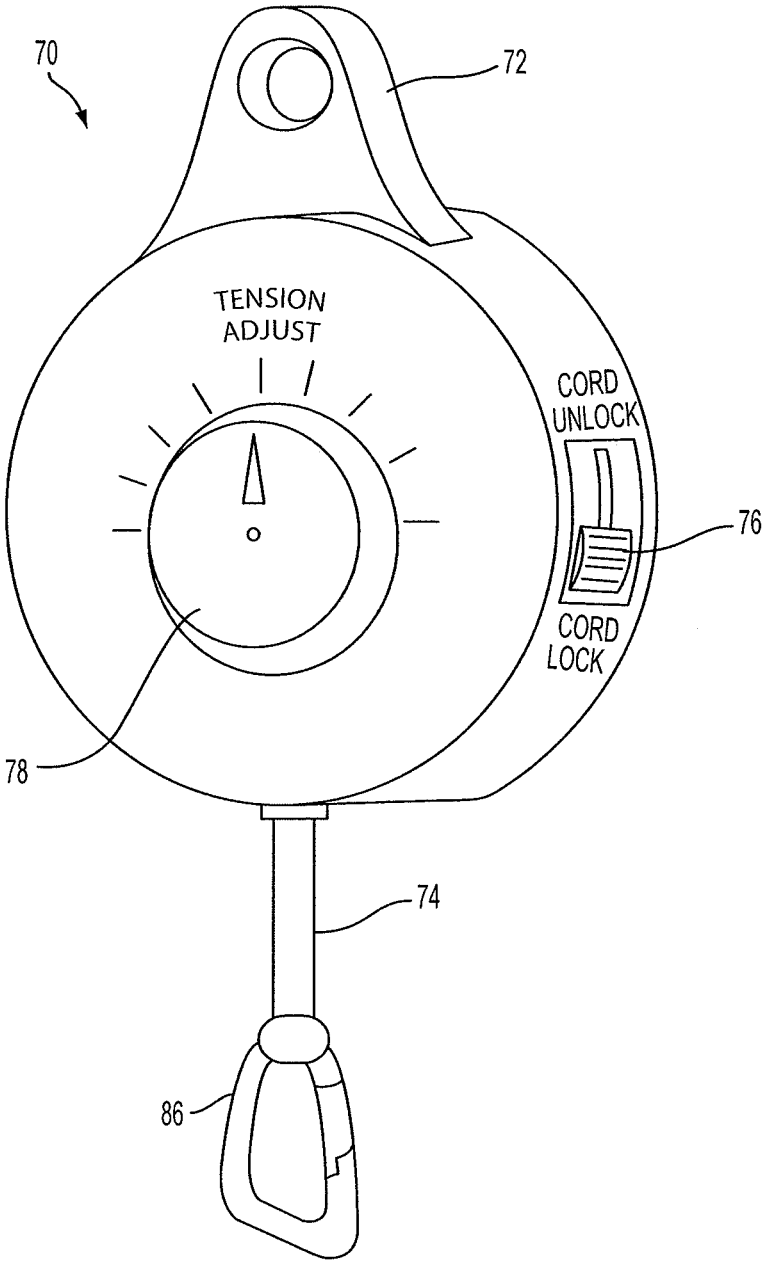
FIG. 8 shows a side perspective view of an elastic member and reel for use with a gait training apparatus, such as shown in FIG. 1.

FIG. 8 shows another embodiment, in which the elastic member 74 (shown again as a bungee or shock cord), may be used in conjunction with a reel 70. For example, at least a portion of the elastic member 74 may be disposed within the reel 70. The reel 70 may be a powered reel, such as, for example, an electromechanical winch. Alternatively, the reel 70 may be a manual reel, in which case a crank may be provided to manually reel up or release the elastic member 74. In yet another embodiment, the reel 70 may include torsion springs or other internal mechanical biasing structures to reel up or release the elastic member 74. The length of the elastic member 74 extending outside of the reel, or, in other words, the unreeled length, may therefore be adjusted for various patients or for various exercises. Additionally, for elastic members 74 having an average spring constant k that varies according to percentage elongation (i.e., having a first average spring constant k1 between 0% to 5% elongation and a second average spring constant k2 between 5% to 10% elongation, etc.) the average spring constant k of the elastic member 74 may be tailored by altering the length of the elastic member 74 that hangs from the reel 70 (i.e., selecting a length to achieve an elongation range corresponding to a desired average spring constant k upon loading with a patients weight). In this manner, the system may be tailored or customized according to the individual needs of the patient.

In some embodiments, the reel 70 may hang by a bracket 72. The reel 70 may also include a locking mechanism 76 to hold the unreeled, unstretched length of the elastic member 74 constant at any given time. Therefore, the unreeled length of the elastic member 74 may be adjusted and the reel 70 locked with the locking mechanism 76 before performing an exercise. Then, the reel 70 may be unlocked and the length of the elastic member 74 changed for another exercise or for removal of the patient from the gait training apparatus 90 (FIG. 1). The reel 70 may also be used to facilitate the loading of a patient in the gait training apparatus 90. For example, a length of the elastic member 74 may be let out of the reel 70, a patient may be positioned into a harness 40 connected to the elastic member 74, and then the elastic member 74 may be reeled up into or around the reel 70 while lifting up the patient into a position for gait training.

The reel 70 may optionally include a tension adjustment device 78 in some embodiments. The tension adjustment device 78 may be configured to force the reeling up of the elastic member 74 with more or less force. For example, during the unloading of a patient, the tension may be adjusted lower by using the tension adjustment device 78. During the loading of a patient, the tension may be adjusted higher to help lift the patient into position. In this manner, the reeling force may be adjusted with the tension adjustment device 78.

Figure 9:
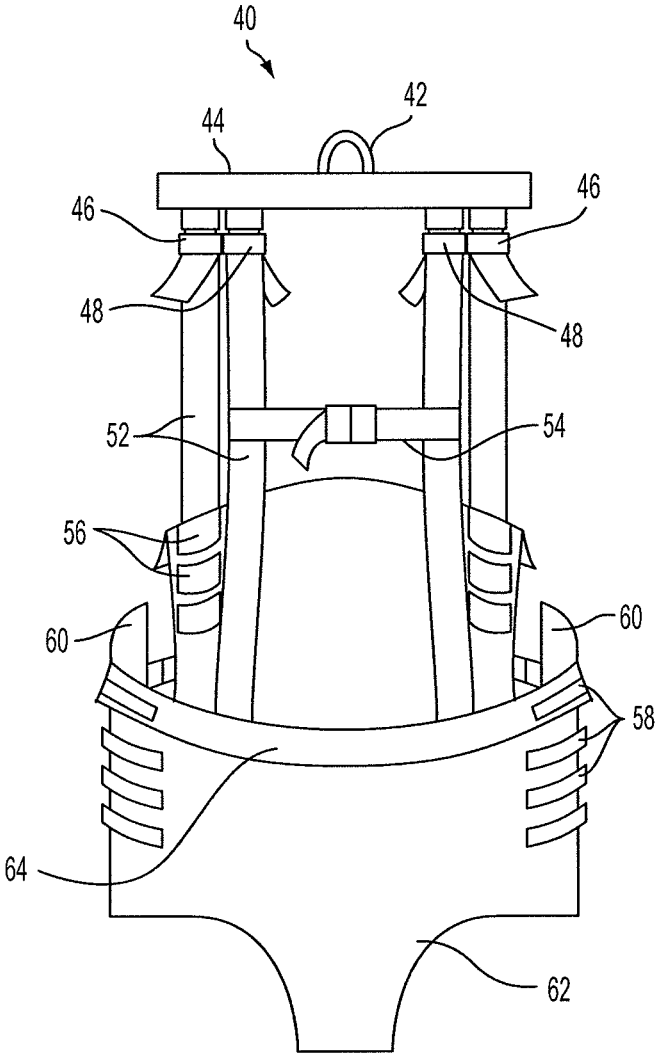
FIG. 9 shows a front view of an adjustable harness for use with a gait training apparatus, such as shown in FIG. 1.

Referring now to FIG. 9, in some embodiments, a harness 40 may include a body support sling 62, suspension straps 52, and a harness attachment ring 42. The harness attachment ring 42 may be positioned on a spreader 44, which may be used to spread the suspension straps 52 apart from each other at their uppermost ends. Posterior length adjustment and release clasps 46 may be attached to the spreader 44 and to the suspension straps 52 that will hang on the posterior of the body support sling 62, so the suspension straps 52 may be adjusted in their length or released and removed during the loading and unloading of a patient in the harness 40. Anterior length adjustment and release clasps 48 may also be similarly positioned and configured. An anterior support strap 54 may optionally extend from one anterior suspension strap 52 to the other anterior suspension strap 52 to hold the suspension straps 52 at a proper distance away from each other across the chest of the patient.

In some embodiments, the body support sling 62 or portions thereof may be made of flexible material, such as a fabric. In other embodiments, the body support sling 62 or portions thereof may be made of a relatively more rigid material, such as a plastic or a fabric including rigid plates therein, to provide additional support for the patient. The body support sling 62 of the harness 40 may include a wrap-around trunk enclosure 60, which may be positioned at least partially around one or more of the pelvis, abdomen, and thorax of the patient when in use.

In some embodiments, the body support sling 62 may include a system for anterior postural control adjustment 58 and a system for posterior postural control adjustment 56. Each of these postural control adjustments 56 and 58 may be configured to increase or decrease the support that the harness 40 gives the patient along the anterior or posterior, respectively, of the patient's pelvis, abdomen, or thorax. As a patient progresses in gait training and becomes more advanced, the support that the harness 40 gives may be reduced to encourage more independent walking, self control of balance and equilibrium, or other mobility of the patient. By way of example, a method for adjusting the postural control of the harness 40 with the systems for postural control adjustment 56 and 58 may include folding down or removing portions of the harness 40 to take away support. For more or higher support, portions of the wrap-around trunk enclosure 60 may be unfolded or added and secured in place. When the postural control is adjusted, the wrap-around trunk enclosure 60 or portions thereof may be secured in place by clasps, straps, snaps, buckles, tying, hook-and-loop type fasteners, or any other means of securing, as will be appreciated by one of ordinary skill. For example, FIG. 9 shows one anterior flap 64 folded down in the front of the harness 40, thus reducing the anterior postural support as compared to a configuration in which the flap is unfolded and secured in a higher position along the suspension straps 52 at the anterior of the harness 40.

While a harness 40 with four detachable suspension straps 52 and postural control adjustment 56 and 58 has been described, in some embodiments, other harnesses 40 may be utilized. For example, a commercially available harness may be utilized, such as a baby bouncer harness, parachute harness, rock-climbing harness, etc. By way of further example, a custom made harness 40 with different features and configurations than the one shown may be utilized. In some embodiments, a device other than a harness 40 may be used, such as a swing seat or a sling. In other words, any device that hangs and is capable of at least partially supporting the weight of a patient may be utilized.

Referring again to FIG. 1, one embodiment of an assembled gait training apparatus 90 is shown. A walker 10 (as described hereinabove with reference to FIG. 2) may be connected to a harness support base frame 20 (as described hereinabove with reference to FIG. 3) using, for example, U-bolts 28 and associated hardware. In other embodiments, the harness support base frame 20 may be attached to the walker 10 by, for example, bolts, tying, adhesives, welding, mechanical interference, or any other suitable device or means for securing the harness support base frame 20 to the walker 10, as will be appreciated by one of ordinary skill in the art. By way of non-limiting example, the harness support base frame 20 may be attached to the walker 10 at three points, such as near the top end of the first elongated member 22 and near the ends of the crossbar 24. It is contemplated by the invention that walkers 10 with different geometries than the one shown in the figures may call for more or fewer points of attachment, for alternative methods of attachment, or for a different configuration of the harness support base frame 20. Some embodiments may include a walker 10 constructed with a harness support base frame 20 integral to the walker, i.e., formed or constructed with and as an integral part of the walker 10.

In some embodiments, as shown in FIG. 1, a suspension arm 30 (as described hereinabove with reference to FIG. 4) may be connected to the harness support base frame 20. By way of example, a portion of the suspension arm 30 may be complementary to and disposed within the first elongated member 22 of the harness support base frame 20. In some embodiments, gravity may be sufficient to keep the suspension arm 30 within and coupled to the first elongated member 22 of the harness support base frame 20. In other embodiments, other means of fastening or attaching the suspension arm 30 to the harness support base frame 20 may be used. This may increase structural integrity and stability of the gait training apparatus. For example, a locking pin, clasp, tie, bolt, weld, adhesive, or other fastening means may attach the suspension arm 30 to the harness support base frame 20.

Alternatively, some embodiments may include a harness support base frame 20 and suspension arm 30 that are formed or constructed as an integral, unitary structure. In such embodiments, the first elongated member 22 of the harness support base frame 20 may extend up and replace the suspension arm upright bar 34 of the suspension arm 30. Embodiments that include an integral, unitary structure for the harness support base frame 20 and the suspension arm 30 may, in some circumstances, reduce cost of manufacture, reduce weight, facilitate assembly, or increase the structural integrity of the gait training apparatus 90. On the other hand, embodiments that include a separate harness support base frame 20 and suspension arm 30 may exhibit increased portability, more possibility of customization, or more compact storage. By way of further, non-limiting example, an embodiment with a separate harness support base frame 20 and suspension arm 30 may enable a user or patient to remove the harness support base frame 29 and suspension arm 30 as the patient progresses in gait training. Thus, the patient may convert the gait training device from a partial weight bearing gait training device with a harness 40 to, for example, simply a walker without a harness 40 and associated hardware as the patient progresses and has no more need of the benefits of the partial weight bearing gait training device.

In alternative embodiments, the harness support base frame 20 and the suspension arm 30 may be connected to each other by a hinged connection (not shown). A locking mechanism may lock the suspension arm 30 in an upright configuration when the gait training apparatus 90 is used by a patient. When the gait training apparatus 90 is to be stored or transported, the suspension arm 30 may be folded down at the hinged connection. In yet further embodiments, two or more lengths of rods or tubing may be attached end-to-end to form the first elongated member 22 of the harness support frame 20, the suspension arm upright bar 34, or combinations thereof. In other words, the invention contemplates many methods and structures of construction of the harness support base frame 20 and the suspension arm 30 and many methods and structures for attaching or forming these two components of the gait training apparatus 90.

In some embodiments (not shown), the overall height of the suspension arm 30 may be adjustable. For example, the suspension arm 30 and the harness support base frame 20 may be constructed to allow the suspension arm 30 to be positioned in a first secure position, and to be subsequently moved into a second secure position. Both the first elongated member 22 of the harness support base frame 20 and the suspension arm 30 may have one or more holes therein. When the suspension arm 30 is to be lifted from a first secure position to a second secure position, for example, a hole in the suspension arm 30 may be aligned with a hole in the first elongated member 22, and a pin placed therethrough to secure the suspension arm 30 in position. Multiple holes may be used to establish multiple secure positions, and therefore multiple heights, of the suspension arm 30.

In continued reference to FIG. 1, an elastic member 74 (as described hereinabove with reference to the alternative embodiments in FIGS. 5 through 8) may be connected to the suspension arm 30 by a hook, ring, carabiner, snap, loop, bracket, or other fastener. Optionally, a reel 70 may be disposed between the suspension arm 30 and the elastic member 74, as described hereinabove with reference to FIG. 8 and as shown in FIG. 1. Alternatively, the elastic member 74 may be tied, looped, bolted, or otherwise fastened directly onto the suspension arm 30. A harness 40 (as described hereinabove with reference to FIG. 9) may hang from the elastic member 74 to provide partial weight bearing for a patient. The elastic member 74 may be undampened to allow at least some bouncing of the harness 40 hanging from the elastic member 74. This bouncing motion may assist the patient in some circumstances, particularly when the patient is a developmentally challenged child. Even limited bodily movement and motion may result in a bouncing motion, due to the undampened elastic member 74, and the bouncing motion may facilitate moving the gait training apparatus 90 across a space.

In some embodiments, at least one wheel of the wheels 14 (FIG. 2) may include a braking device. For example, the rear wheels may be prevented from rotating by the braking device and when a patient bounces, swings, or otherwise moves in the harness 40 and the weight of the patient is transferred primarily to the rear wheels, movement in a rearward direction may be prevented. However, the front wheels may rotate freely and when the patient bounces, swings, or otherwise moves in the harness 40 and the weight of the patient is transferred primarily to the front wheels, movement in a forward direction may be facilitated. In additional embodiments, the braking device maybe a ratcheting device, that allows the at least one wheel to rotate in one direction, such as a forward direction, and that impedes the at least one wheel from rotating in the other direction, such as a rearward direction. Thus, when a patient bounces, swings, or otherwise moves in the harness 40, translation of the gait training apparatus 90 across a space in a specific direction, such as a forward direction, is facilitated.

The patient may recognize benefits in bouncing and be encouraged to bounce in the harness 40 more. For example, the patient may have restricted mobility when unassisted, and the ability to achieve locomotion by bouncing may provide a significant reward for the behavior. Thus, a patient can learn that certain body movements, such as a shifting of body weight, may produce the result of moving across a space, which may be a helpful step in the gait training of some patients. For example, a patient that has the ability to shift their upper body weight, but has difficulty in lower body control, may achieve locomotion through shifting their upper body weight. Over time, the patient may strengthen their upper body and core muscles, improve overall strength and coordination, and eventually improve lower body control.

In some embodiments, as shown in FIG. 1, the elastic member 74 may be connected to the suspension arm 30 at a single location along the suspension arm 30 to allow, for example, ease of assembly, lower cost of materials, and more freedom of movement of the patient, as opposed to connecting the elastic member 74 at more than one location along the suspension arm 30.

Although this invention has been described with reference to particular embodiments, the invention is not limited to these described embodiments. Rather, the invention is limited only by the appended claims, which include within their scope all equivalent devices, systems and methods. Additions, deletions, and modifications to the disclosed embodiments may be effected without departing from the scope of the invention as claimed herein. Similarly, features from one embodiment may be combined with those of another while remaining within the scope of the invention.

What is claimed is:

1. A gait training apparatus, comprising:

a walker comprising:

a walker frame; and at least two wheels operatively coupled to the walker frame;

a harness support base frame attached to the walker frame;

a suspension arm coupled to the harness support base frame;

an undampened elastic member connected to the suspension arm; and a harness connected to the undampened elastic member; and further comprising a reel connected to the undampened elastic member, the reel configured to adjust an unreeled length of the undampened elastic member.

2. The apparatus of claim 1, wherein the undampened elastic member comprises an elastic cord.

* * * * *